US009205950B2

(12) United States Patent
Roesler

(10) Patent No.: US 9,205,950 B2
(45) Date of Patent: Dec. 8, 2015

(54) PACKAGING BOX WITH A MULTITUDE OF INDIVIDUAL BOXES

(71) Applicant: Peter Roesler, Wangen (DE)

(72) Inventor: Peter Roesler, Wangen (DE)

( * ) Notice: Subject to any disclaimer, the term of this patent is extended or adjusted under 35 U.S.C. 154(b) by 0 days.

(21) Appl. No.: 13/942,959

(22) Filed: Jul. 16, 2013

(65) Prior Publication Data

US 2014/0021086 A1 Jan. 23, 2014

(30) Foreign Application Priority Data

Jul. 16, 2012 (DE) ..... 10 2012 013 927

(51) Int. Cl.
*B65D 21/02* (2006.01)
*B65D 1/30* (2006.01)
*B65D 43/16* (2006.01)

(52) U.S. Cl.
CPC ..... *B65D 21/0204* (2013.01); *B65D 1/30* (2013.01); *B65D 43/162* (2013.01)

(58) Field of Classification Search
CPC .... B65D 21/0204; B65D 1/30; B65D 43/162; B65D 21/0201; B65D 21/02; A61J 1/035; A61J 1/03; A61J 7/04
USPC ..... 206/538, 558, 534; 220/23.4, 23.2, 220/23.8, 23.83
See application file for complete search history.

(56) References Cited

U.S. PATENT DOCUMENTS

| | | | | |
|---|---|---|---|---|
| 3,245,528 | A * | 4/1966 | Holley | 206/504 |
| 4,084,695 | A * | 4/1978 | Halbich | 206/532 |
| 4,372,445 | A * | 2/1983 | Keffeler | 206/532 |
| 4,829,006 | A * | 5/1989 | Smith et al. | 435/305.3 |
| 5,409,127 | A * | 4/1995 | Stratford et al. | 220/23.4 |
| 5,735,406 | A * | 4/1998 | Keffeler | 206/535 |
| 5,806,670 | A * | 9/1998 | Harlan et al. | 206/232 |
| 7,658,296 | B2 * | 2/2010 | Van Handel et al. | 220/23.4 |
| 7,793,785 | B2 * | 9/2010 | Keffeler et al. | 206/538 |
| 7,802,695 | B2 * | 9/2010 | Baker et al. | 220/835 |
| 7,828,149 | B2 * | 11/2010 | Kalvelage et al. | 206/538 |
| 7,845,147 | B2 * | 12/2010 | Henderson et al. | 53/471 |
| 8,146,627 | B2 * | 4/2012 | Mazur | 141/247 |
| 2002/0079313 | A1 * | 6/2002 | Grayson | 220/23.4 |
| 2003/0230582 | A1 * | 12/2003 | Whitmore et al. | 220/507 |
| 2004/0089581 | A1 * | 5/2004 | Dienst | 206/538 |
| 2004/0164076 | A1 * | 8/2004 | Baker et al. | 220/23.4 |
| 2005/0011898 | A1 * | 1/2005 | Van Handel et al. | 220/507 |
| 2005/0218031 | A1 * | 10/2005 | Murphy | 206/538 |
| 2006/0086641 | A1 * | 4/2006 | Priebe et al. | 206/538 |
| 2010/0288672 | A1 * | 11/2010 | Murphy | 206/538 |

FOREIGN PATENT DOCUMENTS

| | | | |
|---|---|---|---|
| DE | 9014386 | U1 | 1/1992 |
| DE | 9414118 | U1 | 12/1994 |
| DE | 19646845 | C1 | 2/1998 |

* cited by examiner

*Primary Examiner* — Steven A. Reynolds
(74) *Attorney, Agent, or Firm* — Cohen & Grigsby

(57) ABSTRACT

Packaging system (1) including multiple interconnected lockable boxes (2-5) that can be closed with at least one cover (8), wherein the boxes (2-5) in each case are interconnected on a panel, such as the side panel (30), by forming a spacer joint (7) and thereby form a box row (14, 15), and that in each case a box row is connected with the adjacent box row (14, 15) by forming a dividing joint (6) via a film hinge (18) and dividers bridging the film hinge (18).

17 Claims, 5 Drawing Sheets

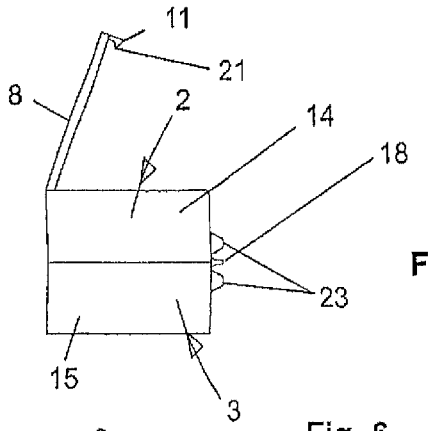
Fig. 5
Fig. 6
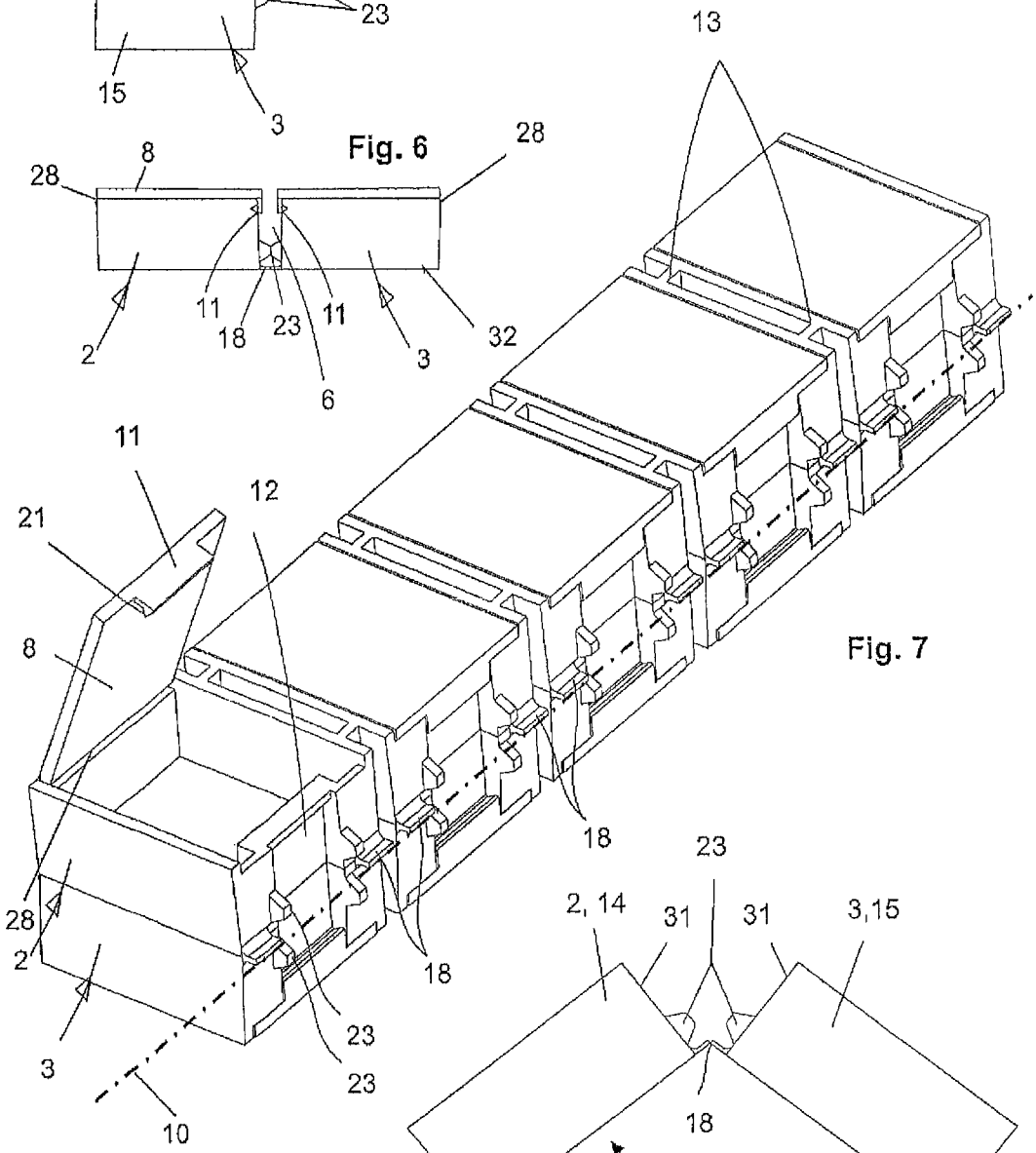
Fig. 7
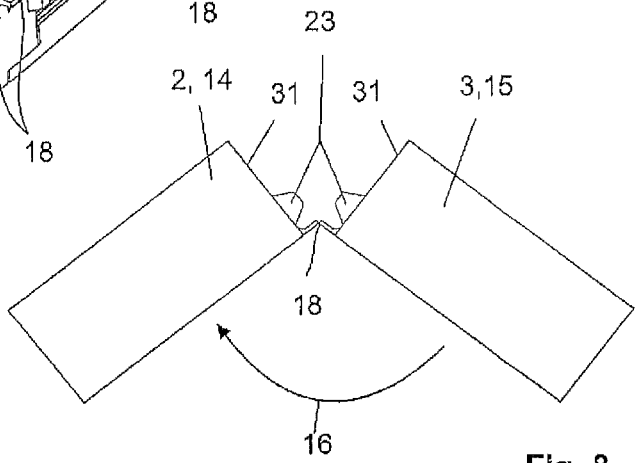
Fig. 8

PACKAGING BOX WITH A MULTITUDE OF INDIVIDUAL BOXES

CROSS-REFERENCE TO RELATED APPLICATIONS

The present application claims the benefit of priority of Application No. 10 2012 013 927.6 filed in Germany on Jul. 16, 2012, the rights of priority of which are claimed in the present application and the subject matter of which is incorporated herein by reference in its entirety.

BACKGROUND OF THE INVENTION

1. Technical Field of the Invention

The presently disclosed invention relates to a packaging system comprising multiple interconnected lockable boxes that can be closed with at least one cover. The packaging system is suitable to package a multiplicity of items such as, for example, small tool parts, accessories, medical products, pills or tablets, candies or the like. The disclosed packaging box allows these items to be assigned a separate compartment or a separate box.

2. Description of the Related Art

Such a packaging system was disclosed, for example, by the subject in DE 90 14 386 U1. In this document, the packaging system has a single cover that covers multiple individual compartments, wherein an item to be packaged is arranged in each compartment. The joint cover is pivotally mounted on the housing by a film hinge. A disadvantage of such a packaging system, however, is that the articles to be packaged are covered by the single cover, and its own cover is therefore not allocated to each divided compartment. Therefore, only the opening of the packing box can be controlled overall by a tamper-proof closure on the cover. In addition, it is not intended that each item to be packaged is placed in a separate box to which an individual cover is allocated.

DE 196 46 845 C1 and DE 94 14 118 U1 show a packing system or box for packaging small items. The packaging system is divided into individual compartments here as well, and a common cover is available. This also has the disadvantage that the removal of a single item from an allocated compartment cannot be controlled. The packaging box shown in DE 196 46 845 C1 is stackable.

The presently disclosed invention is therefore based on the objective to continue to develop a packaging system comprising multiple interconnected lockable boxes that can be closed with at least one cover so that individual items can be packaged in separate compartments and the removal of such an item can also be controlled from separate compartments. A further objective consists thereof that individual packaging items can be separated from each other.

SUMMARY OF THE INVENTION

The above stated objects are achieved by the presently disclosed invention, which relates to a packaging system comprising multiple interconnected lockable boxes that can be closed with at least one cover, wherein the boxes in each case are interconnected on a panel, such as a side panel, by forming a spacer joint and thereby form a box row, and that in each case a box row is connected with the adjacent box row by forming a dividing joint via a film hinge and dividers bridging the film hinge.

In the present disclosure, the term packaging box and packaging system may be used interchangeably, and may be taken to mean the composite of multiple interconnected individual boxes.

An essential feature of the presently disclosed invention is that the packaging system consists of multiple interconnected boxes that each can be closed by at least one cover, wherein according to an additional feature of the presently disclosed invention, the boxes can either be separated by rows or can be separated individually from the group of said packaging system.

For this purpose, it is also provided according to another feature of the presently disclosed invention, that the boxes are connected to each other on a panel, for example, the side panel, to form a spacing gap and thereby form a series of individual juxtaposed boxes, wherein one box row is connected with the adjacent box set by forming a separating gap through a film hinge.

This special arrangement means that serially interconnected boxes now form a box row and the one box row is connected with the adjacent bordering box row by a film hinge.

The individual box rows are therefore pivotally connected to one another via a film hinge. According to another feature of the presently disclosed invention, it is provided that the pivotal connection is bridged by the film hinge through a breakable separating divider.

The separating divider therefore connects the facing surfaces of the boxes which form the box rows. If one now wants to bend the one box row toward the other under the effect of the film hinge, it is necessary first to break open the dividers between the box rows. This results in an audible cracking sound that proves that a box row was separated from the other adjacent box row then is only connected by the film hinge that connects the two box rows in the direction of the longitudinal axis.

In principle, the presently disclosed invention is a one-piece packing box which consists, for example, of interconnected and molded together boxes, but which can be opened and closed individually, wherein a separate cover is allocated to each box. The boxes that are interconnected in the longitudinal direction form a box row in the form of a longitudinal latch, and box rows interconnected in the longitudinal direction (longitudinal latches) are connected pivotally by a longitudinally extending film hinge.

In an embodiment of the presently disclosed invention, it is preferable if the cover is formed as a hinged cover, which is connected pivotally to a side panel of the box body via a film hinge.

However, the presently disclosed invention is not limited to this. Instead of a hinged cover or a pivoting cover, a sliding cover can also be used.

In a third design, it is provided that the cover is formed by a tear-off film, so that this would be a single effective closure.

In a preferred design, the packaging system, for example, consists of ten individual boxes, wherein the packaging system can be divided manually into a random number of single boxes without the aid of tools. The individual boxes are therefore interconnected into columns and rows via dividers—as previously described—wherein additional box rows are formed, which are interconnected by dividers as well as a film hinge that bridges the dividers.

The thereby formed boxes are located next to each other before bending the box row. When bending, the dividers are separated and a cracking sound can be heard.

Based on the effect of the film hinge, the box rows can be pivoted toward each other at an angle of 180 degrees, so that the bottom surface of the boxes of the one box row is parallel to and at a reciprocal distance to the bottom surface of the boxes of the other box row. The box rows that are located back-to-back can then be locked with each other on the bottom, so that there is a box strip consisting of two box rows.

The box strips located back-to-back to each then form an approximately square cross-section and the length of this doubled box strip may be several times the cross-section.

Five latches with five boxes to be opened and allocated covers are then formed, for example. Double boxes with two covers to be individually opened can then be broken off, and it is also possible to break off every individual box with a cover to be individually opened from the entire composite of the packaging system.

A special feature of the presently disclosed invention is that a tamper-proof closure is formed by the type, location and arrangement of the cover, which makes it possible that the covers can only be opened when a box row is bent with respect to the adjacent box row, wherein the dividers are broken off between the two box rows and the two box rows only remain connected by the film hinge extending in the longitudinal direction.

The pivot axis of the covers formed by the film hinge is facing the film hinge connecting the box rows.

It is furthermore preferred that the cover has a handle with a locking lip at its front pivotal end, which can be locked on the back panel of the box. It is then further intended that all back panels of the boxes are pivotally joined to form a divider with one locked in another method via the film hinge, as described below.

It is therefore intended that the width of the divider is dimensioned between the box rows so that the operation of the handle on the cover is only possible by using the fingers of a human hand, if the adjacent boxes arranged in the area of the dividers are broken open and the width of the divider is increased by pivoting the box rows around the pivot axis of the film hinge.

In order to open the cover of the boxes of a box row, first the dividers between the box row must be broken open in order to then pivot the film hinge, so as to increase the width of the divider, so that the fingers of a human hand can reach into these divider to be able to take the handle for actuating and open the cover.

According to another feature of the presently disclosed invention, it is also provided that the dividers between the individual boxes are not only used for the formation of box rows, but that the boxes are also connected to one another via columns of frangible dividers. By the row- and column-like arrangement of individual boxes which together form the packaging system, the advantage is achieved in that certain boxes can be separated as row, wherein the divider of this row may be broken through and the film hinge can be torn off.

It is also possible after separating the individual box rows to break off the individual boxes of this row from the box row by breaking off the dividers that are also located between the boxes of this row.

In this manner, such a packaging system consists of multiple individual boxes that are arranged in rows and columns. If required, any number of boxes can be broken off. The cover belonging to the respective box remains with the box, since the cover is also fused on to the individual box via a film hinge according to a preferred design.

Accordingly, the entire packaging system without folding is very difficult to open, because—as mentioned—the handles of the covers required for opening only become accessible by bending the divider to be expanded between the box rows. After bending, the individual boxes in this row can be separately opened.

If a label with a perforation is used, which corresponds to the column and row arrangement of the individual boxes, double latches must be capable of being safely separated without damaging the seal. The packaging system according to the presently disclosed invention can be automatically fitted and sealed.

The object of the presently disclosed invention not only results from the objects of the individual patent claims, but also from the combination of the individual patent claims among each other.

BRIEF DESCRIPTION OF THE DRAWINGS

All information and characteristics disclosed in the documents, including the summary, especially the layout shown in the drawings, are claimed as essential to the presently disclosed invention as far as they are new individually or in combination compared with the state of the art.

The presently disclosed invention is explained in detail by the following and with reference to one drawing that illustrates a single design method of the presently disclosed invention. Additional invention-essential characteristics and advantages are derived here from the drawings and their description, but other are within the scope of the present invention.

In the drawings:

FIG. 1 shows a perspective view of a packaging system consisting of two rows according to an embodiment of the presently disclosed invention;

FIG. 2 shows the arrangement according to FIG. 1 with individually opened boxes, which are partially separated from each other;

FIG. 3 shows the bottom view of the arrangement according to FIG. 1 in the partially bent position, in order to then open the cover;

FIG. 4 shows the further bending position of the two folded rows of boxes resulting from FIG. 3;

FIG. 5 shows the front view of an arrangement according to FIG. 4 with an open box;

FIG. 6 shows the front view of an arrangement according to FIG. 1;

FIG. 7 shows an enlarged perspective view of an arrangement according to FIG. 4;

FIG. 8 shows the front view of the arrangement according to FIG. 3;

FIG. 9 shows the perspective view of the separation of two adjacent boxes according to an embodiment of the presently disclosed invention;

FIG. 10 shows the perspective view of the separation of the two boxes separated according to FIG. 9;

FIG. 11 shows a perspective view of the packaging according to FIG. 1 with open boxes; and FIG. 12 shows the perspective illustration of the packaging system according to FIG. 1 with a glued, perforated label.

DESCRIPTION OF THE PRESENTLY PREFERRED EMBODIMENTS

Figure 1:
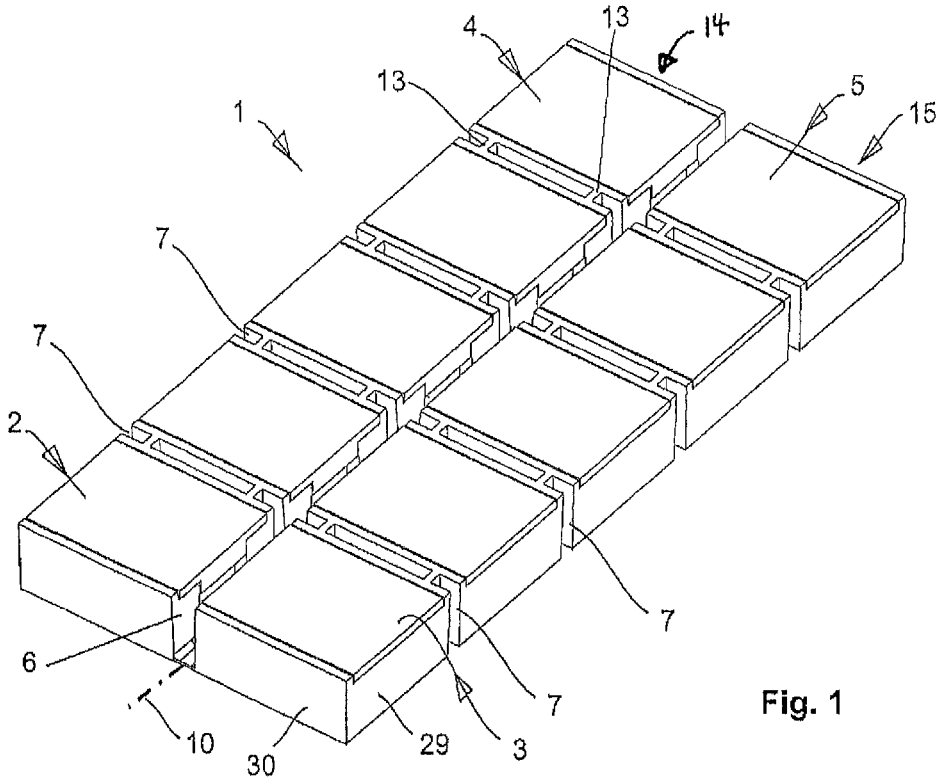
Figure 2:
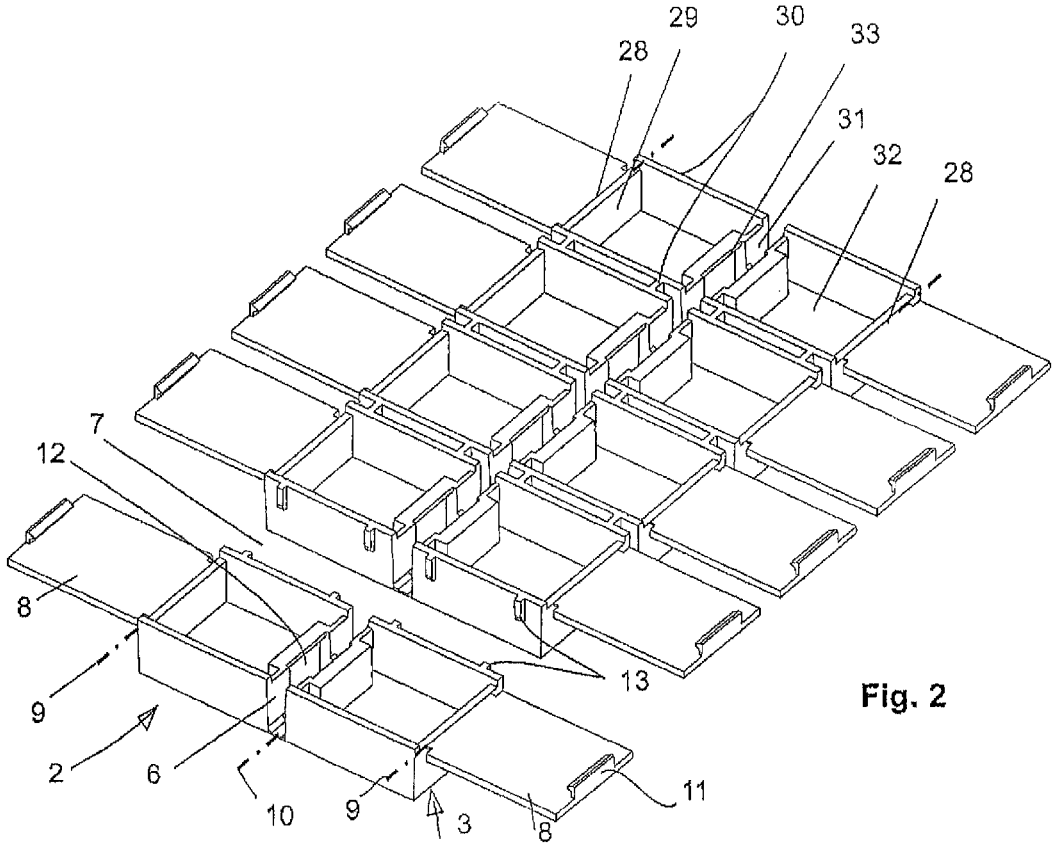

Packaging system 1 consisting of multiple boxes 2, 3, 4 and 5 is shown in perspective in FIGS. 1 and 2.

Only a so-called double latch is illustrated, which means that boxes 2, 4 and 3, 5 form separable and facing bendable box rows 14 and 15.

Once all boxes 2-5 are identically formed, it is sufficient to describe the structure as a single box. Accordingly, for reasons of simplification, only the front box 2, 3 and the rearmost box 4, 5 of the respective box rows 14 and 15 are described by numbers according to FIG. 1.

Instead of the presentation of a double latch according to FIG. 1, any number of box rows 14, 15 can be lined up together, and they can be of any length.

In the design shown, each box row 14 or 15 consists of five identical boxes 2, 4 and 3, 5 that can be aligned in a row. However, each box row may comprise other numbers of boxes, as envisioned to be within the scope of the presently disclosed invention.

According to the presently disclosed invention, a box row divider joint 6 is arranged between each box row 14, 15, which extends centrally along the entire longitudinal side and a film hinge 18 (FIGS. 3 and 4) is arranged at its bottom.

The film hinge 18 (FIGS. 3 and 4) forms a box row divider pivot axis 10 around which the two facing box rows 14, 15 may be pivotally connected via the film hinge 18.

Each box 2-5 consists of facing parallel side panels 30, an outwardly directed front panel 29, and a rear panel 31 (FIG. 2) that is aligned in a direction to the box row divider joint 6. Furthermore, the interior of each box 2-5 is limited by a bottom panel 32 (FIG. 2).

Boxes 2-5 can have an arbitrary cross-section of any size and any shape. It is merely shown as an example that boxes 2-5 approximately form a square contour, to which the presently disclosed invention is not limited. The boxes or cartons therefore can be round, polygonal, oval or have any other shape.

FIG. 2 shows the open position of all boxes 2-5, wherein can be seen that each box 2-5 is covered by a cover 8, which is pivotally arranged in a cover pivot axis 9 by means of a cover film hinge 28 to the respective front panel 29.

Boxes 2, 4 and 3, 5, constituting the lined up box rows 14, 15 are aligned so that the free pivoting end of the respective cover 8 extends inwards into the box row divider joint 6.

Figure 3:
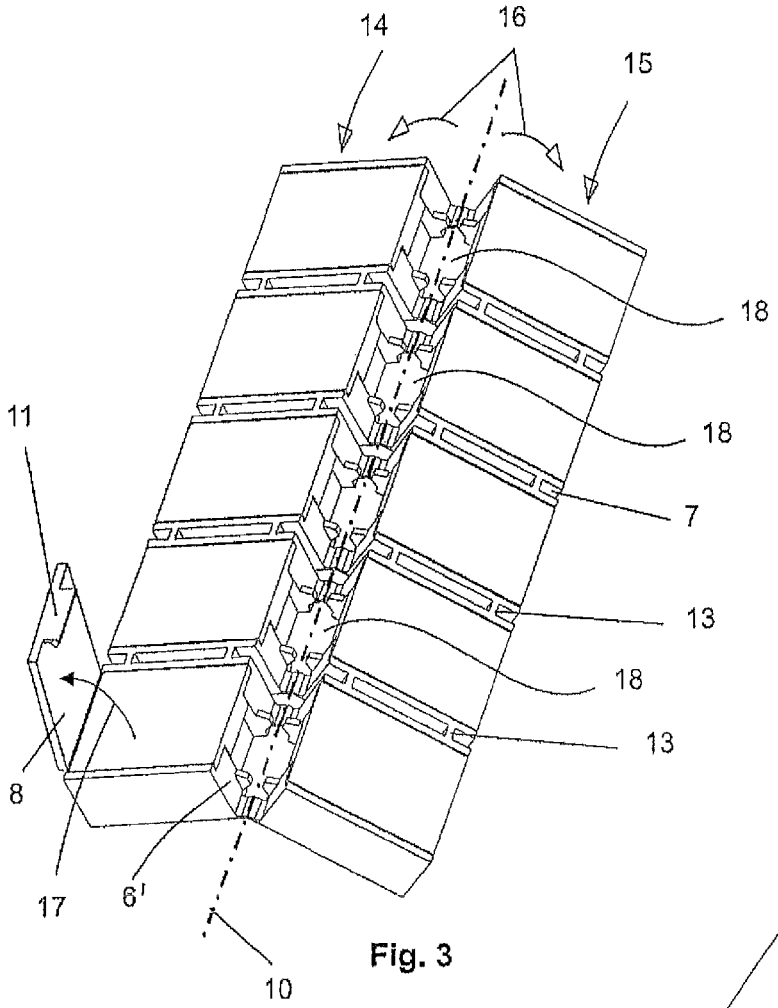
Figure 4:
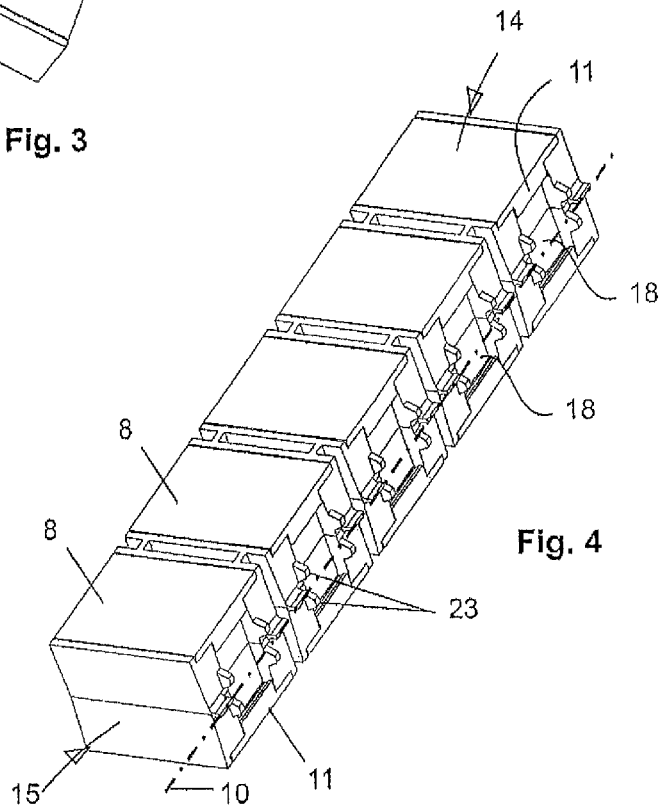

According to FIG. 3, each cover 8 has a handle 11 that is aligned perpendicular to the level of the cover 8, on the lower inward pointing end of which an inward facing latching lip 21 is arranged as shown in FIG. 5. The latching lip 21 is movable to mesh respectively with an allocated locking edge 33 (FIG. 2) in the area of a recess 12 that is formed on the rear panel 31.

Boxes 2, 3 and 4, 5 that extend transversely to the box row divider joint 6 are kept apart from each other by a spacing joint 7 that extends perpendicular to the box row divider joint 6, wherein breakable dividers 13 are arranged in the spacing joint 7 (FIG. 1 and FIG. 7).

Boxes 2, 3 extending perpendicular to the box row divider joint 6 can therefore also be broken off as shown in FIG. 1 by a bending movement in reference to the rest of boxes 4, 5 that form packaging system 1, whereby the breakable dividers 13 are separated and, for example, the front boxes 2, 3 are broken off by the double latch of the packaging system 1. This is illustrated in FIG. 2.

A comparison of FIG. 1 and FIG. 2 also shows that the handles 11 reach into the space of the box row divider joint 6 for the pivotal actuation of the respective cover 8, and the width of the box row divider joint 6 is selected so that one cannot reach into this joint 6 with the finger of one hand, in order to activate the cover 8. This is a special safety measure and tamper-proof closure position, as shown in FIG. 6. FIG. 6 also shows that the film hinge 18 required for the pivot activation of the box rows 14, 15 is arranged on the bottom, i.e. at the level of the bottom panel 32 of boxes 2-5.

However, plastic dividers 23 (FIG. 4) are provided above and at a short distance from here, which form a plastic composite in the position illustrated in FIG. 6 and have a predetermined breaking point in the center. The predetermined breaking points on the dividers 23 are thereby broken off by bending the two box rows 14, 15 in the direction of arrow 16 (FIG. 3 and FIG. 8), whereby an audible cracking sound occurs. The two box rows 14, are then successively pivoted, as shown in FIG. 5 and FIG. 7. They are therefore located bottom-to-bottom together, as shown in the front view of FIG. 5 and the perspective view in FIG. 7.

However, they are still connected pivotally by the bottom film hinge 18, so that they can again be pivoted apart again.

Here, it is preferable that the fully swung-open position according to FIG. 5 and FIG. 7, that is, when the two box rows 14, 15 are folded upon each other, is locked by a lock acting between the bottom panel of a box row and the bottom panel 32 of the other box row.

Such a lock, for example, may consist of a knob, which engages in an allocated locking recess on the opposite bottom panel 32.

Such a folded double latch according to FIG. 7 may provide for space-saving storage, may be easily transported, and each box 2-5 can be individually opened by activating the cover 8.

The presently disclosed invention is not limited to the fact that the film hinge 18 according to FIG. 6 at the bottom is arranged at the height of the bottom panel 32.

The film hinge could also be offset piecewise toward the rear panel 31 (FIG. 8) in the direction of the upper cover 8. Each cover 8 is also arranged in the direction of the arrow 17 pivoted on the cover film hinge 28 (FIG. 3).

Instead of the arrangement of the pivot covers 8, movable covers may also be used.

Figure 9:
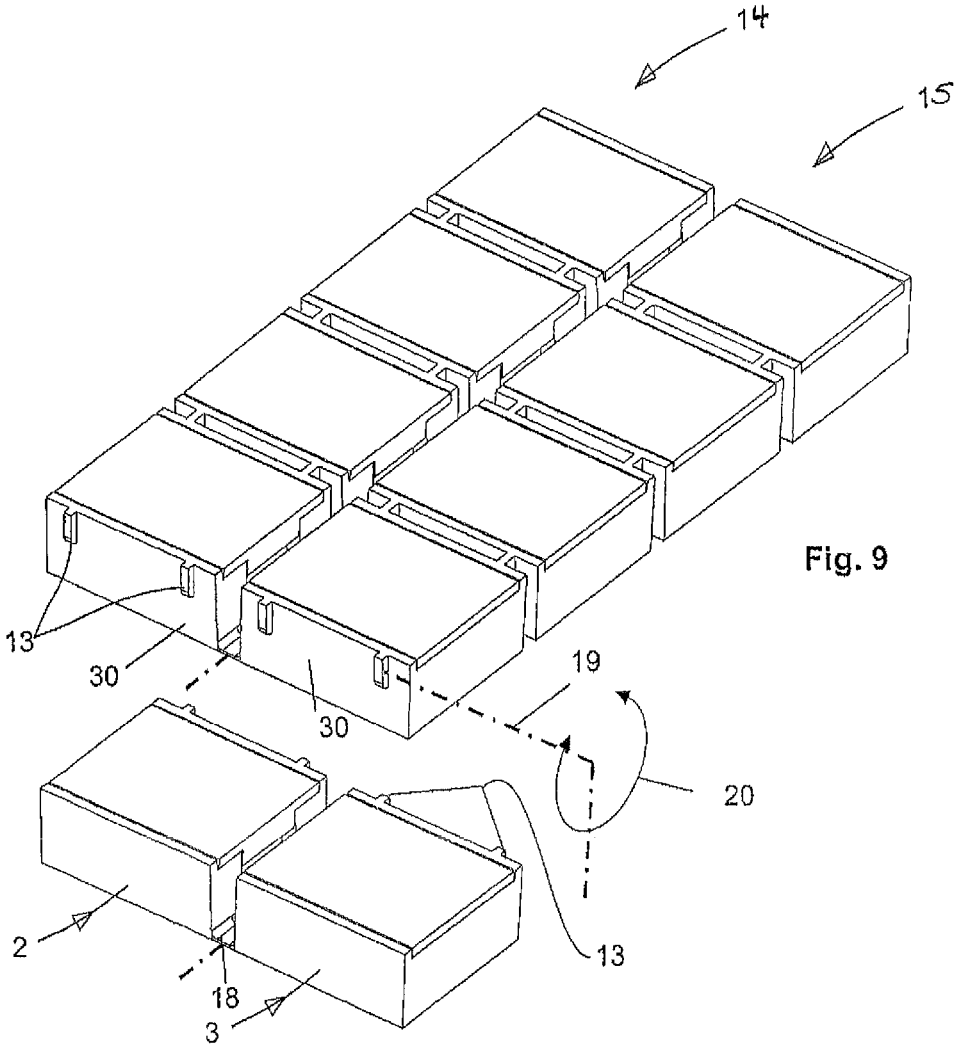

FIG. 9 also shows the separation of two more boxes 2, 3, which originate from the various rows of boxes 14, 15. For this purpose, the front boxes 2, 3 are pivoted in the direction of the arrow 20 to the breaking axis 19, wherein the breakable dividers 13 arranged in the area of the side panels 30 break open at their predetermined breaking point, and the two boxes 2, 3 can therefore easily be separated from the double latch of box rows 14, 15.

Figure 10:
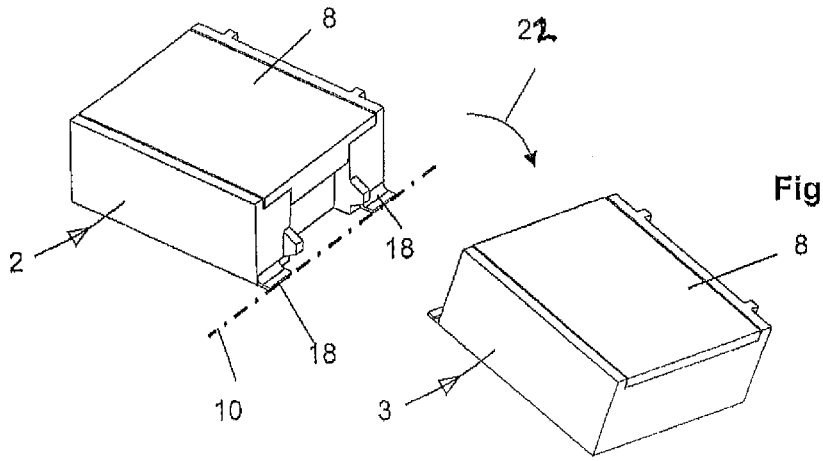

FIG. 10 furthermore shows that the boxes 2, 3 still interconnected by the film hinge 18 may also be separated from each other by pulling apart the two boxes 2, 3 in the direction of the arrow 22, whereby the film hinge 18 tears open.

Figure 11:
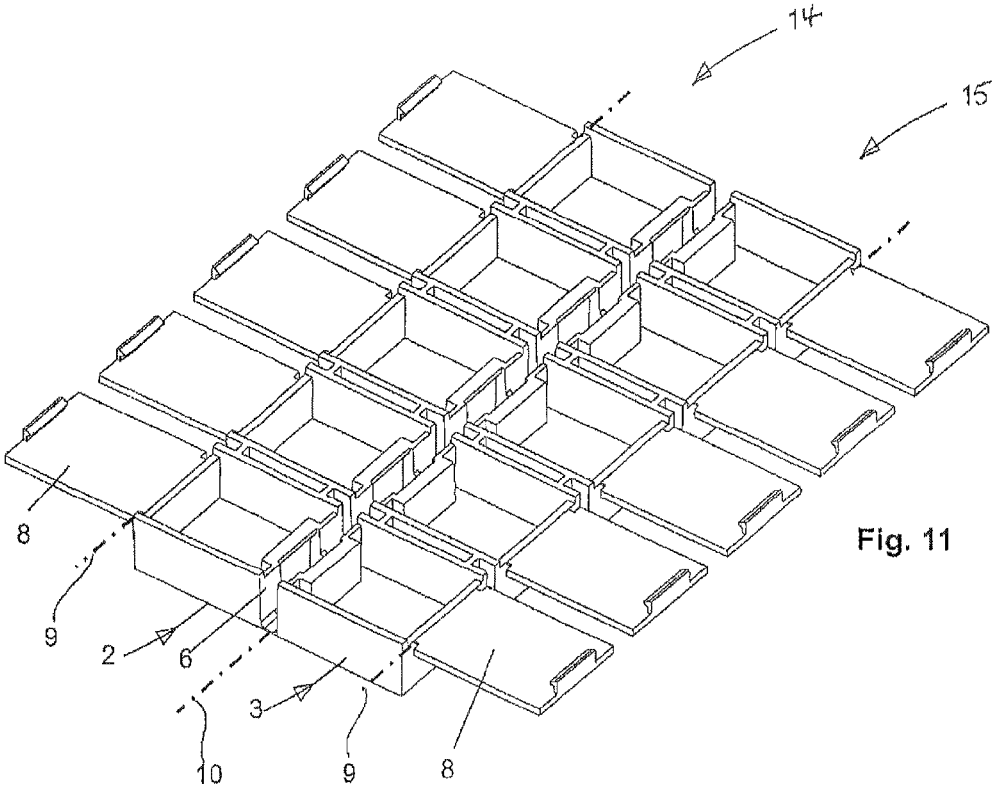
Figure 12:
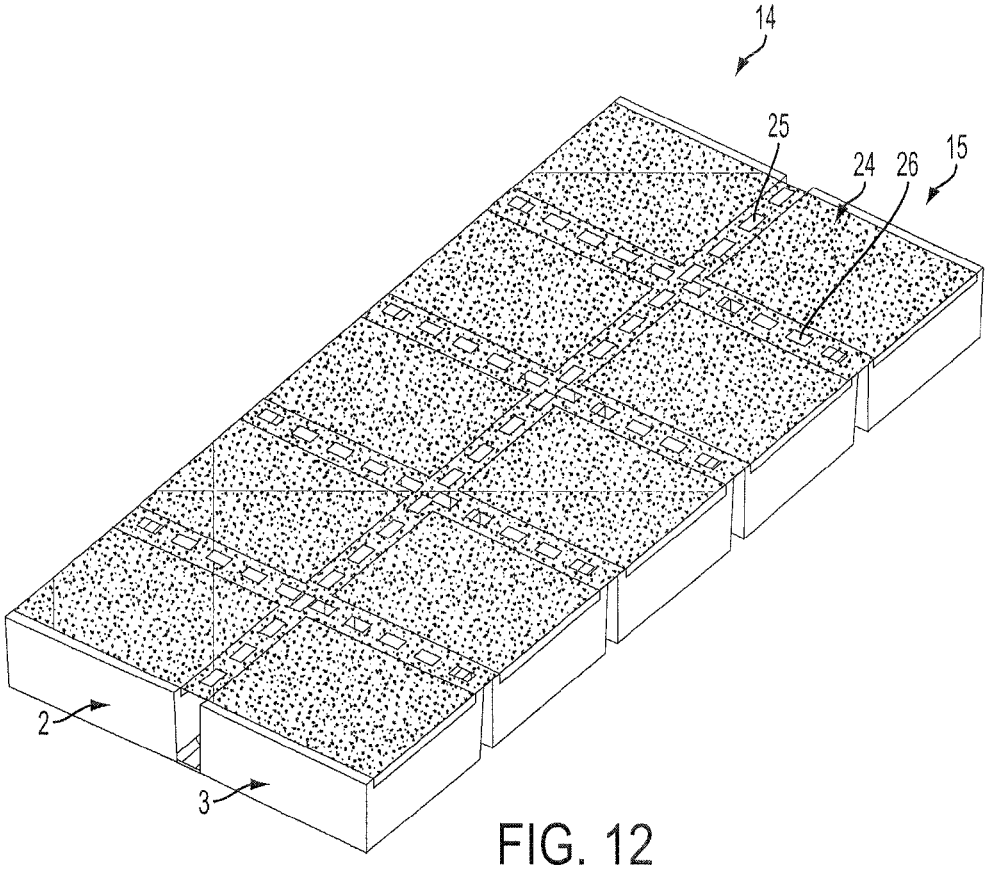

FIG. 11 shows an overall view of the packaging system 1 with all boxes 2-5, the covers 8 of which are opened.

As tamper-proof seal, provided is a label 24 that may be glued onto the closed hinged cover 8, which has row and column-wise arranged perforation lines 25, 26 which correspond with the profile of the joints 6, 7.

In this way, it is possible to separate the box row 14 from the box row 15 without damaging the remaining arrangement and thereby tear open the perforation line 25, however, whereby the perforation lines 26 remain unaffected. The boxes can only then also be separated along their perforation lines 26 after a further division of a box row 14, 15.

| Drawing legend | |
|---|---|
| 1 | Packaging system |
| 2 | Box |
| 3 | Box |
| 4 | Box |
| 5 | Box |
| 6 | Box row divider joint |
| 7 | Spacing joint |
| 8 | Cover |
| 9 | Cover pivot axis (of 8) |
| 10 | Box row divider pivot axis (of 6) |
| 11 | Handle |
| 12 | Recess |
| 13 | Breakable Divider (lateral surface) |

-continued

| Drawing legend | |
|---|---|
| 14 | Box row |
| 15 | Box row |
| 16 | Direction of arrow |
| 17 | Direction of arrow |
| 18 | Film hinge (bottom) |
| 19 | Breaking axis |
| 20 | Direction of arrow |
| 21 | Latching lip |
| 22 | Direction of arrow |
| 23 | Divider (bottom area) |
| 24 | Label |
| 25 | Perforation line |
| 26 | Perforation line |
| 28 | Cover film hinge (of 8) |
| 29 | Front panel |
| 30 | Side panel |
| 31 | Rear panel |
| 32 | Bottom panel |
| 33 | Locking edge |

What is claimed is:

1. A system of packaging boxes, said system comprising:

a first row of at least two boxes, each of said boxes having at least one side panel and a bottom panel that is connected to said side panel at a level that limits the interior of each box;

a cover for each of said respective boxes, each of said covers being connected to said box oppositely from the level of said bottom panel;

at least one additional row of at least two boxes, each of said additional rows being aligned with said first row and each box of each additional row corresponding to a respective box in said first row;

at least two spacing joints, a respective one of said spacing joints connecting oppositely facing side panels of each two adjacent boxes in said first row, and a respective one of said spacing joints connecting oppositely facing side panels of each two adjacent boxes in said additional rows; and at least two divider joints, each of said divider joints connecting a box in said first row to the corresponding box of an adjacent row, each of said divider joints including a film hinge that is connected to each box in said first row at the level of the bottom panel of said each box, said film hinge also being connected to the corresponding box of said adjacent row at the level of the bottom panel of said corresponding box such that each box in said first row is pivotal about said film hinge with respect to said corresponding box of said adjacent row to move the bottom of said each box of said first row toward the bottom of said corresponding box in said adjacent row.

2. The system of claim 1 wherein each of said boxes includes a respective front panel and wherein a cover hinge pivotally connects the respective cover for said box to said front panel.

3. The system of claim 2 wherein each of said cover hinges is located on a respective box oppositely from said film hinge that connects the box to the corresponding box in an adjacent row.

4. The system of claim 2 wherein each of said boxes includes a respective back panel that is located oppositely on said box from said front panel and wherein each of said covers includes a respective handle that is located oppositely on said cover from said cover hinge, said handle defining a locking lip at the distil end of said handle, said locking lip being engageable with said back panel to secure said cover in a closed position on said box.

5. The system of claim 4 wherein the film hinge connects the back panel of each box of one row to the back panel of a respective box of an adjacent row to pivotally connect the box of the one row to the corresponding box in said adjacent row.

6. The system of claim 1 wherein said divider joint further includes dividers that bridge said film hinge, each box of said one row being rigidly connected to a corresponding box of said adjacent row by at least one of said dividers, said dividers being breakable in response to the pivotal movement of the box of said first row with respect to the box of said second row about said film hinge.

7. The system of claim 6 wherein said cover includes a handle and wherein said divider joint separates the respective box of said one row from the corresponding box of said adjacent row by a dimension that affords user access to the handle of the cover of the respective boxes only at times when the dividers of said dividing joint are broken by the pivotal movement of the box in said one row with respect to the corresponding box in said adjacent row about said film hinge.

8. The system of claim 1 wherein said spacing joints comprise rigid dividers that are breakable by the pivotal movement of a box in one row with respect to an adjacent box in the same row about a breaking axis that is longitudinally aligned with said spacing joint.

9. The system of claim 1 further comprising a label that covers at least two of said covers, said label having perforations corresponding at least one of said spacing joints, said divider joints, or a combination of at least one of said spacing joints and at least one of said divider joints.

10. A system of packaging boxes, said system comprising:

a first row of at least two boxes, each of said boxes having at least one side panel and a bottom panel that is connected to said side panel at a level that limits the interior of each box;

a cover for each of said respective boxes, each of said covers being connected to said box oppositely from the level of said bottom panel;

at least one additional row of at least two boxes, each of said additional rows being aligned with said first row and each box of each additional row corresponding to a respective box in said first row;

at least two spacing joints, a respective one of said spacing joints connecting oppositely facing side panels of each two adjacent boxes in said first row, and a respective one of said spacing joints connecting oppositely facing side panels of each two adjacent boxes in said additional rows; and at least two divider joints, each of said divider joints connecting a box in said first row to the corresponding box of an adjacent row, each of said divider joints including:

a film hinge that is connected to each box in said first row at the level of the bottom panel of said each box, said film hinge also being connected to the corresponding box of said adjacent row at the level of the bottom panel of said corresponding box such that each box in said first row is pivotal about said film hinge with respect to said corresponding box of said adjacent row to move the bottom of said each box of said first row toward the bottom of said corresponding box in said adjacent row; and a plurality of dividers that bridge said film hinge, at least one of said dividers rigidly connecting each box of said one row to a corresponding box of said adjacent row, said dividers being located at a level on said box between the level of said bottom panel and the level of said cover, said dividers being breakable in response to the pivotal movement of the box of said first row with respect to the box of said second row about said film hinge.

11. The system of claim 10 wherein each of said boxes includes a respective front panel and wherein a cover hinge pivotally connects the respective cover for said box to said front panel.

12. The system of claim 11 wherein each of said cover hinges is located on a respective box oppositely from said film hinge that connects the box to the corresponding box in an adjacent row.

13. The system of claim 11 wherein each of said boxes includes a respective back panel that is located oppositely on said box from said front panel and wherein each of said covers includes a respective handle that is located oppositely on said cover from said cover hinge, said handle defining a locking lip at the distil end of said handle, said locking lip being engageable with said back panel to secure said cover in a closed position on said box.

14. The system of claim 13 wherein the film hinge connects the back panel of each box of one row to the back panel of a respective box of an adjacent row to pivotally connect the box of the one row to the corresponding box in said adjacent row.

15. The system of claim 10 wherein said cover includes a handle and wherein said divider joint separates the respective box of said one row from the corresponding box of said adjacent row by a dimension that affords user access to the handle of the cover of the respective boxes only at times when the dividers of said dividing joint are broken by the pivotal movement of the box in said one row with respect to the corresponding box in said adjacent row about said film hinge.

16. The system of claim 10 wherein said spacing joints comprise rigid dividers that are breakable by the pivotal movement of a box in one row with respect to an adjacent box in the same row about a breaking axis that is longitudinally aligned with said spacing joint.

17. The system of claim 10 further comprising a label that covers at least two of said covers, said label having perforations corresponding at least one of said spacing joints, said divider joints, or a combination of at least one of said spacing joints and at least one of said divider joints.

* * * * *